US008955960B2

(12) United States Patent
Asada et al.

(10) Patent No.: US 8,955,960 B2
(45) Date of Patent: Feb. 17, 2015

(54) TRAY UNIT AND IMAGE RECORDING DEVICE

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 277 days.

(21) Appl. No.: 13/244,053

(22) Filed: Sep. 23, 2011

(65) Prior Publication Data

US 2012/0081489 A1 Apr. 5, 2012

(30) Foreign Application Priority Data

Sep. 30, 2010 (JP) ..... 2010-223032

(51) Int. Cl.

| | |
|---|---|
| ***B41J 2/01*** | (2006.01) |
| ***B65H 1/26*** | (2006.01) |
| *B41J 17/26* | (2006.01) |
| *B41J 13/10* | (2006.01) |
| *B41J 11/00* | (2006.01) |
| *B41J 11/06* | (2006.01) |

(52) U.S. Cl.

CPC ..... *B65H 1/266* (2013.01); *B41J 17/26* (2013.01); *B41J 13/10* (2013.01); *B41J 11/0015* (2013.01); *B41J 11/06* (2013.01); *B65H 2402/31* (2013.01); *B65H 2402/32* (2013.01); *B65H 2405/332* (2013.01); *B65H 2405/3322* (2013.01); *B65H 2801/06* (2013.01)

USPC ..... 347/104; 347/101; 347/108

(58) Field of Classification Search

USPC ..... 347/104, 101, 108; 271/9.08, 9.07, 271/9.11, 162, 164

See application file for complete search history.

(56) References Cited

U.S. PATENT DOCUMENTS

| | | | | |
|---|---|---|---|---|
| 3,989,236 | A | | 11/1976 | Komori et al. |
| 4,056,835 | A | * | 11/1977 | Whitney et al. ..... 360/251 |
| 4,131,274 | A | * | 12/1978 | Sue ..... 271/9.11 |
| 4,135,805 | A | | 1/1979 | Taylor et al. |
| 4,645,192 | A | * | 2/1987 | Watanabe ..... 271/9.09 |
| 4,928,129 | A | | 5/1990 | Honda |

(Continued)

FOREIGN PATENT DOCUMENTS

| | | | | |
|---|---|---|---|---|
| CN | 101445191 | A | | 6/2009 |
| JP | 02225228 | A | * | 9/1990 |

(Continued)

OTHER PUBLICATIONS

United States Patent and Trademark Office, Office Action for U.S. Appl. No. 12/894,030 (co-pending U.S. patent application), mailed Aug. 1, 2012.

(Continued)

*Primary Examiner* — Laura Martin
*Assistant Examiner* — Leonard S Liang
(74) *Attorney, Agent, or Firm* — Baker Botts L.L.P.

(57) ABSTRACT

A tray unit includes a first tray, a second tray, and a cover. The first tray includes a first holding surface for holding thereon a first sheet. The second tray includes a second holding surface for holding thereon a second sheet and is configured to slide above and along the first holding surface from a second position to a first position in a first sliding direction and from the first position to the second position in a second sliding direction opposite to the first sliding direction. The cover is configured to cover from above at least a part of the second tray when the second tray is in the second position.

25 Claims, 10 Drawing Sheets

(56) References Cited

U.S. PATENT DOCUMENTS

| | | | | |
|---|---|---|---|---|
| 5,357,385 | A * | 10/1994 | Shimizu et al. | 360/96.51 |
| 5,647,585 | A | 7/1997 | Cheong | |
| 6,659,444 | B2 | 12/2003 | Kawamara | |
| 7,403,739 | B2 | 7/2008 | Hwang | |
| 7,497,565 | B2 * | 3/2009 | Kinoshita et al. | 347/101 |
| 7,547,011 | B2 | 6/2009 | Kurata et al. | |
| 7,584,950 | B2 | 9/2009 | Asada et al. | |
| 7,600,745 | B2 | 10/2009 | Asada | |
| 7,628,392 | B2 | 12/2009 | Shiohara et al. | |
| 7,654,515 | B2 | 2/2010 | Koga | |
| 7,677,548 | B2 | 3/2010 | Chino | |
| 7,681,875 | B2 | 3/2010 | Asada et al. | |
| 7,690,640 | B2 | 4/2010 | Koga et al. | |
| 7,694,951 | B2 * | 4/2010 | Shiohara | 271/9.08 |
| 7,731,179 | B2 * | 6/2010 | Izuchi et al. | 271/145 |
| 7,748,692 | B2 | 7/2010 | Shiohara | |
| 7,850,170 | B2 * | 12/2010 | Matsue et al. | 271/294 |
| 7,862,037 | B2 * | 1/2011 | Kunioka | 271/171 |
| 7,878,500 | B2 | 2/2011 | Wakakusa | |
| 7,883,284 | B2 * | 2/2011 | Asada et al. | 400/624 |
| 8,020,849 | B2 * | 9/2011 | Izuchi et al. | 271/9.11 |
| 2005/0052518 | A1 * | 3/2005 | Kagami | 347/104 |
| 2005/0225025 | A1 | 10/2005 | Chikumoto | |
| 2006/0017794 | A1 * | 1/2006 | Kinoshita et al. | 347/104 |
| 2006/0113723 | A1 * | 6/2006 | Ito et al. | 271/162 |
| 2006/0262355 | A1 | 11/2006 | Kurata et al. | |
| 2007/0013760 | A1 * | 1/2007 | Takahashi | 347/104 |
| 2007/0075476 | A1 | 4/2007 | Shiohara | |
| 2007/0182803 | A1 | 8/2007 | Asada et al. | |
| 2007/0200285 | A1 * | 8/2007 | Shiohara | 271/162 |
| 2007/0201921 | A1 * | 8/2007 | Asada et al. | 399/393 |
| 2007/0201923 | A1 * | 8/2007 | Asada et al. | 399/405 |
| 2008/0023023 | A1 * | 1/2008 | Boye et al. | 132/294 |
| 2008/0237977 | A1 * | 10/2008 | Izuchi et al. | 271/264 |
| 2009/0001652 | A1 | 1/2009 | Asada | |
| 2009/0140484 | A1 | 6/2009 | Asada | |
| 2009/0206539 | A1 | 8/2009 | Takeuchi et al. | |
| 2010/0164169 | A1 | 7/2010 | Wakakusa | |
| 2011/0241288 | A1 | 10/2011 | Asada et al. | |
| 2012/0080833 | A1 | 4/2012 | Asada et al. | |
| 2012/0081488 | A1 | 4/2012 | Asada et al. | |

FOREIGN PATENT DOCUMENTS

| | | | |
|---|---|---|---|
| JP | H06-008138 | Y2 | 3/1994 |
| JP | H08-12096 | A | 1/1996 |
| JP | 2006-347767 | A | 12/2006 |
| JP | 2007-230777 | A | 9/2007 |
| JP | 2009-020257 | A | 1/2009 |
| JP | 2009-107846 | A | 5/2009 |
| JP | 2010-037095 | A | 2/2010 |
| JP | 2010-159162 | A | 7/2010 |

OTHER PUBLICATIONS

United States Patent and Trademark Office, Office Action for U.S. Appl. No. 13/242,395 (co-pending U.S. patent application), mailed Sep. 11, 2012.

United States Patent and Trademark Office, Non Final Office Action for U.S. Appl. No. 13/841,947 (related to above-captioned patent application), mailed Jul. 15, 2013.

United States Patent and Trademark Office, Office Action for U.S. Appl. No. 12/894,030 (counterpart to above-captioned patent application), mailed Feb. 16, 2012.

United States Patent and Trademark Office, Non Final Office Action for U.S. Appl. No. 13/242,214 (related to above-captioned patent application), mailed Oct. 2, 2013.

State Intellectual Property Office of the People's Republic of China, Notification of First Office Action for Chinese Patent Application No. 201110302111.4 (counterpart to above-captioned patent application), mailed Dec. 27, 2013.

United States Patent and Trademark Office, Final Rejection for U.S. Appl. No. 13/841,947 (related to above-captioned patent application), mailed Jan. 27, 2014.

United States Patent and Trademark Office, Non-Final Office Action for U.S. Appl. No. 13/242,214 (related to above-captioned patent application), dated May 22, 2014.

Japan Patent Office, Notice of Reasons for Rejection for Japanese Patent Application No. 2010-223029 (related to above-captioned patent application), mailed Jan. 21, 2014.

Japan Patent Office, Notice of Reasons for Rejection for Japanese Patent Application No. 2010-223032 (related to above-captioned patent application), mailed Feb. 4, 2014.

Japan Patent Office, Notice of Reasons for Rejection for Japanese Patent Application No. 2010-223116 (related to above-captioned patent application), mailed Feb. 4, 2014.

United States Patent and Trademark Office, Final Office Action for U.S. Appl. No. 13/242,214 (related to above-captioned application), dated Dec. 10, 2014.

* cited by examiner

TRAY UNIT AND IMAGE RECORDING DEVICE

CROSS REFERENCE TO RELATED APPLICATION

The present application claims priority from Japanese Patent Application Publication No. JP-2010-223032, which was filed on Sep. 30, 2010, the disclosure of which is incorporated herein by reference in its entirety.

BACKGROUND OF THE INVENTION

1. Field of the Invention

The present invention relates to a tray unit for storing recording media, e.g., sheets, and relates to an image recording device configured to convey a recording medium stored in a tray unit and to record an image on the recording medium.

2. Description of Related Art

A known image recording device comprises a tray unit comprising a main tray and a second tray each configured to hold thereon recording media. For example, A4 and B5 size recording sheets are placed on the main tray, and postcards are placed on the second tray. The second tray is disposed above the main tray and is configured to slide above the main tray between a position allowing a feed roller to contact the second tray and a position separated from the feed roller. The feed roller selectively feeds the sheets from the main tray and the second tray depending on the position of the second tray.

SUMMARY OF THE INVENTION

It may be beneficial to enhance the usability of a plurality of trays for use in an image recording device.

According to an embodiment of the invention, a tray unit comprises a first tray, a second tray, and a cover. The first tray comprises a first holding surface for holding thereon a first sheet. The second tray comprises a second holding surface for holding thereon a second sheet and is configured to slide above and along the first holding surface from a second position to a first position in a first sliding direction and from the first position to the second position in a second sliding direction opposite to the first sliding direction. The cover is configured to cover from above at least a part of the second tray when the second tray is in the second position.

According to another embodiment of the invention, an image recording device comprises a first tray, a second tray, a cover, a feeder, a recording unit, and a discharging unit. The first tray comprises a first holding surface for holding thereon a first sheet. The second tray comprises a second holding surface for holding thereon a second sheet and is configured to slide above and along the first holding surface from a second position to a first position in a first sliding direction and from the first position to the second position in a second sliding direction opposite to the first sliding direction. The cover is configured to cover from above at least a part of the second tray when the second tray is in the second position. The feeder is configured to feed the first sheet when the second tray is in the second position and to feed the second sheet when the second tray is in the first position. The recording unit is configured to record an image on the sheet fed by the feeder. The discharging unit is disposed above the cover and is configured to discharge the sheet after the recording unit records the image on the sheet.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-10C, like numerals being used for like corresponding parts in the various drawings.

Figure 1:
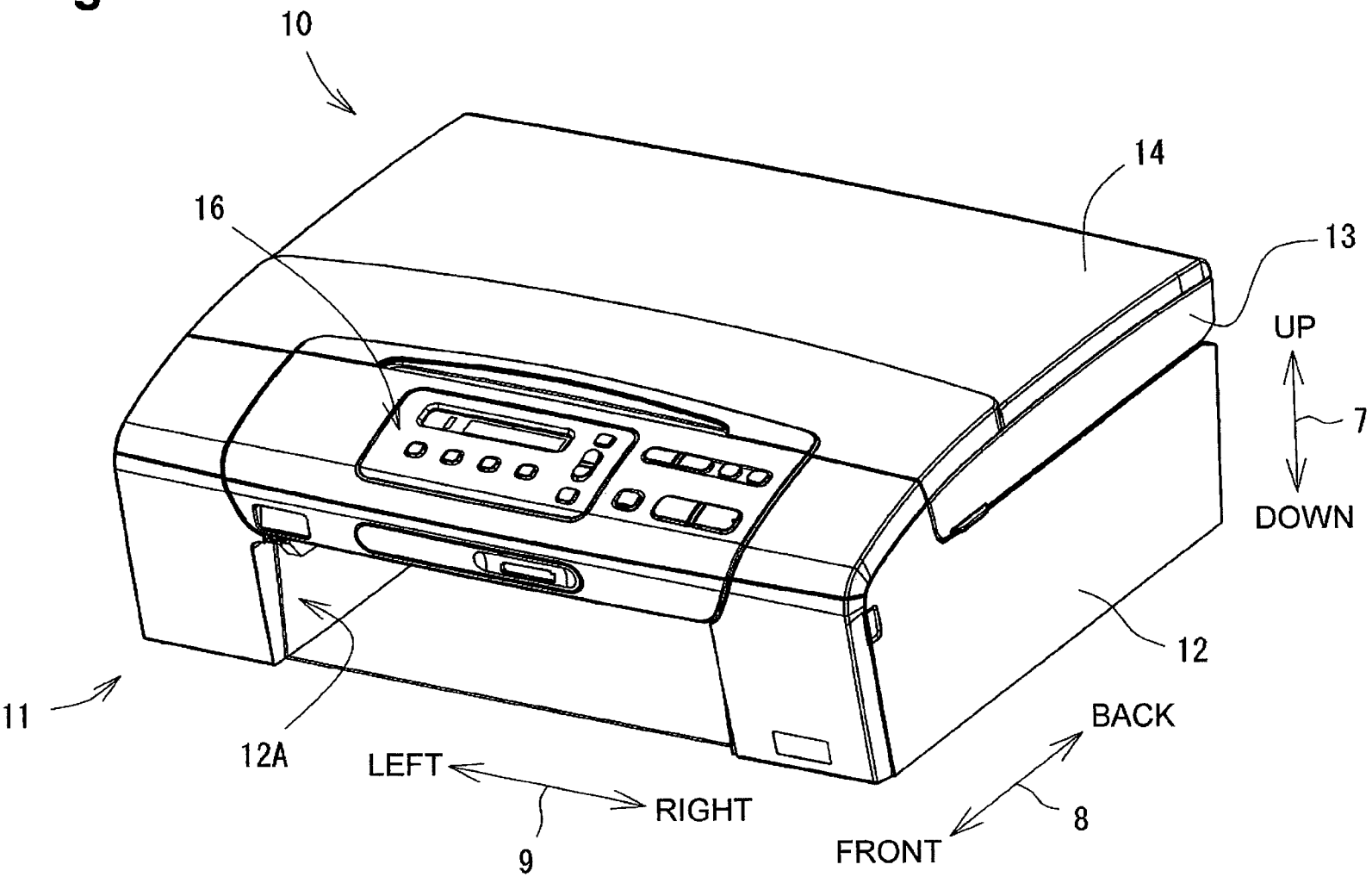
FIG. 1 is a perspective view of a main unit of an image recording device according to an embodiment of the invention.

An embodiment of the present invention will be described with reference to the drawings. In the present embodiment, an image recording device 10 comprises a main unit 11 shown in FIG. 1 and a tray unit 50 shown in FIG. 4 that is mounted into the main unit 11. As shown in FIG. 1, the main unit 11 of the image recording device 10 has a substantially rectangular parallelepiped external shape. In the following description, the height direction of the main unit 11 of the image recording device 10 is defined as an up-down direction 7, the depth direction thereof is defined as a front-back direction 8, and the width direction thereof is defined as a left-right direction 9. The tray unit 50 will be described as being mounted into the main unit 11 of the image recording device 10.

A general structure of the main unit 11 of the image recording device 10 will be described. The main unit 11 comprises a printer housing 12, a scanner housing 13 mounted on the top surface of the printer housing 12, and a document cover 14 mounted on the top surface of the scanner housing 13. The image recording device 10 is a multifunction device having a printing function, a scanning function, and a coping function.

An opening 12A through which the tray unit 50 (see FIG. 4) is inserted or extracted is formed at a lower front of the printer housing 12. The printer housing 12 comprises guiderails (not shown) that support the tray unit 50 such that the tray unit 50 is slidable in the front-back direction 8. The tray unit 50 may be supported by the printer housing 12 such that the tray unit 50 is detachable from the printer housing 12, or such that the tray unit 50 is slidable over the sliding range. A printer 15 (see FIG. 2), which will be described below, is housed in an upper area of the printer housing 12. The printer 15 records images on recording media, e.g., sheets 54. The sheets 54 are, for example, recording sheets, glossy sheets, or postcards.

The scanner housing 13 supports the document cover 14 such that the document cover 14 is openable and closable. A document sheet (not shown) can be placed on the scanner housing 13, and be retained by being sandwiched between the scanner housing 13 and the document cover 14. An image on the retained document sheet is scanned by a flatbed scanner that is housed in the scanner housing 13, and is captured as image data. The scanner and the printer 15 are controlled by a control circuit (not shown). The control circuit receives information from a plurality of input buttons 16 shown in FIG. 1 or an external device, such as a personal computer, and controls the operations of the scanner and the printer 15 on the basis of the received information. Thus, an image capturing operation and an image recording operation are performed.

Figure 2:
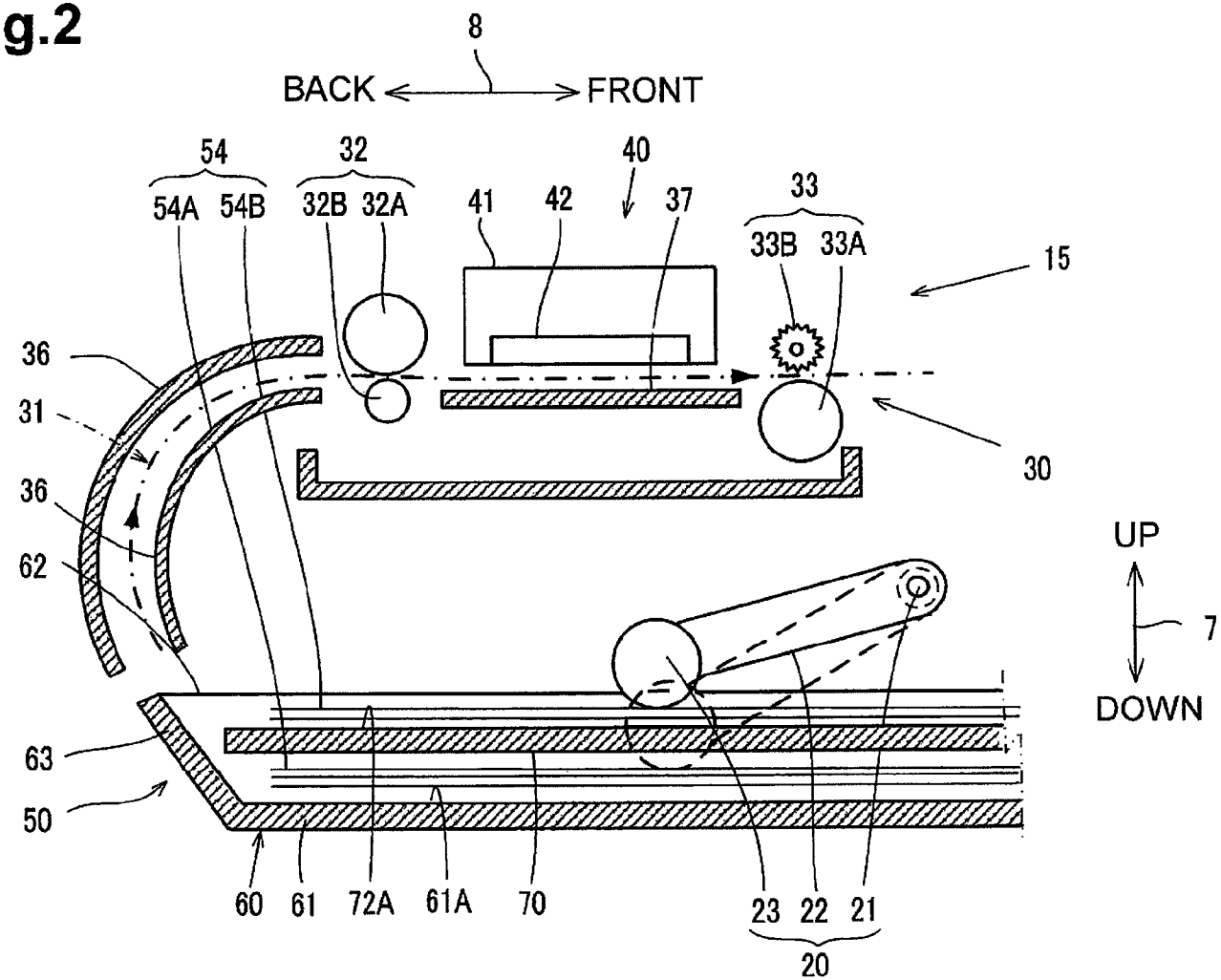
FIG. 2 is a schematic cross-sectional view of a printer of the image recording device.
Figure 3:
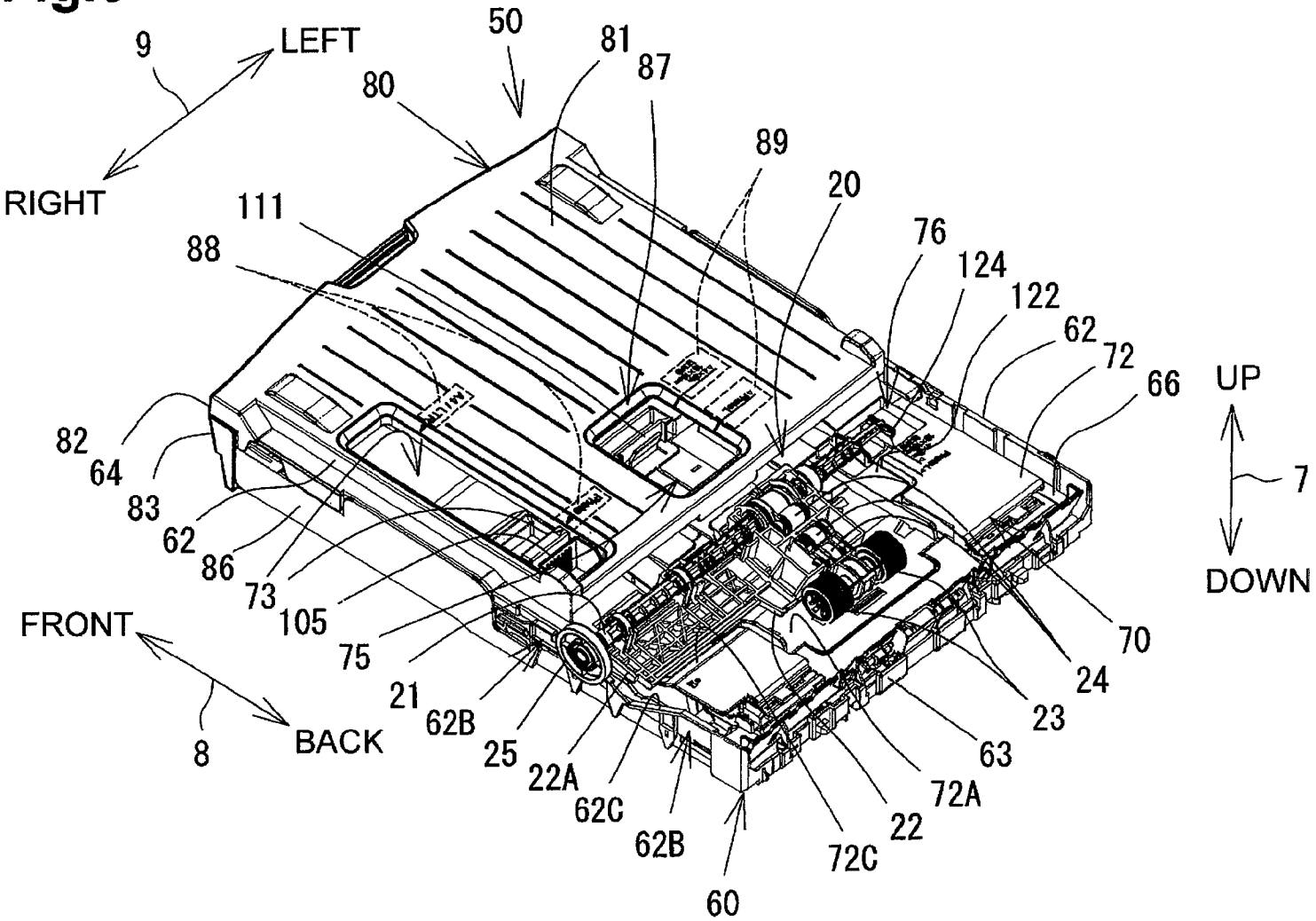
FIG. 3 is a perspective view of a feeder of the image recording device.

As shown in FIG. 2, the printer 15 comprises a feeder 20 that feeds the sheets 54 stored in the tray unit 50 from the tray unit 50; a sheet conveyor 30 that conveys the sheets 54 fed by the feeder 20; a recording unit 40 that records images on the sheets 54 conveyed by the sheet conveyor 30; and a drive unit (not shown) that drives the recording unit 40, the sheet conveyor 30, and the scanner. The drive unit comprises a plurality of motors and a driving force transmitting mechanism that transmits the driving force of the motors to the sheet conveyor 30, the scanner, and other components. The motors are controlled by the above-described control circuit.

The feeder 20 comprises a shaft 21 that is rotatably supported by, for example, a frame fixed to the printer housing 12; an arm 22 supported by the shaft 21; and left and right feed rollers 23 supported by the arm 22.

The shaft 21 is rod-shaped and extends in the left-right direction 9. A gear 25 that is rotated by the above-described drive unit is attached to an end of the shaft 21. The shaft 21 supports an end of the arm 22 such that the arm 22 is pivotable.

The arm 22 extends in the left-right direction 9 from a central part in which the feed rollers 23 are provided to the right side where a right side wall 62 of the tray unit 50 is located. A contact portion 22A that makes slide contact with the tray unit 50 is provided at a right end portion of the arm 22. The arm 22 pivots about the shaft 21 as the arm 22 makes slide contact with the tray unit 50, and accordingly the other end of the arm 22 moves vertically. The feed rollers 23 are rotatably supported by the other end of the arm 22. Thus, the feed rollers 23 are vertically movable. When the tray unit 50 is mounted into the printer housing 12 (see FIG. 1), the arm 22 makes slide contact with a first contact surface 62C (described below) provided on the right side wall 62 of a main tray 60 or a second contact surface 72C (see FIG. 4) provided on a second tray 70 in the tray unit 50. Accordingly, the arm 22 pivots such that the feed rollers 23 come into contact with a top surface of first sheets 54A or a top surface of second sheets 54B (see FIG. 2) that are stored in the tray unit 50.

The rotation of the shaft 21 is transmitted to the feed rollers 23 through a plurality of transmission gears 24 attached to the arm 22, and the feed rollers 23 are rotated accordingly. The control circuit controls a motor to rotate the feed rollers 23 such that the sheets 54 are fed backward. Each of the sheets 54 that have been fed backward is conveyed by the sheet conveyor 30, which will be described below.

As shown in FIG. 2, the sheet conveyor 30 comprises a convey path 31, a pair of convey rollers 32, and a pair of discharge rollers 33. The convey path 31 is defined by a plurality of guide members 36 and a platen 37. The convey path 31 is formed such that the convey path 31 curves upward from the back end of the tray unit 50 and then extends linearly forward. The platen 37 is positioned above the tray unit 50, and defines a part of a linearly extending portion of the convey path 31.

As shown in FIG. 2, the convey rollers 32 comprise a driving roller 32A that is rotated by the above-described drive unit and a driven roller 32B that is rotated by the rotation of the driving roller 32A. The discharge rollers 33 comprise a drive roller 33A that is rotated by the above-described drive unit and a driven roller 33B that is rotated by the rotation of the drive roller 33A. The convey rollers 32 are disposed behind the platen 37. The discharge rollers 33 are disposed in front of the platen 37 and above a central part of the tray unit 50 in the front-back direction 8. The driving roller 32A of the convey rollers 32 and the driving roller 33A of the discharge rollers 33 are controlled to rotate by the above-described control circuit in a direction for conveying the sheet 54 forward. The sheet 54 is conveyed along the platen 37 by at least one of the pair of convey rollers 32 and the pair of discharge rollers 33, and an image is recorded on the sheet 54 by the recording unit 40, which will be described below.

The recording unit 40 comprises a carriage 41 disposed above the platen 37 and a head 42 retained by the carriage 41. The carriage 41 is supported by guiderails (not shown) such that the carriage 41 is movable in the left-right direction 9. The recording unit 40 ejects ink from the head 42 toward the sheet 54 that is conveyed along the platen 37. Owing to the movement of the recording unit 40 in the left-right direction 9 and the forward movement of the sheet 54, the recording unit 40 is capable of recording an image over substantially the entire area of the sheet 54. Instead of using the recording unit 40 that records an image with ink, a recording unit that records an image with toner may be used.

The sheet 54 on which the image is recorded is discharged by the pair of discharge rollers 33, and is received by the tray unit 50, which will be described below. The pair of discharge rollers 33 is an example of a discharging unit.

As shown in FIGS. 4 to 7, the tray unit 50 has a flattened rectangular parallelepiped external shape, and comprises the main tray 60, the second tray 70 positioned above the main tray 60, and a discharge tray 80 positioned above the second tray 70. In the following description, the thickness direction of the tray unit 50 is defined as an up-down direction 51 of the tray unit 50, the depth direction of the tray unit 50 is defined as a front-back direction 52 of the tray unit 50, and the width direction of the tray unit 50 is defined as a left-right direction 53 of the tray unit 50. When the tray unit 50 is mounted into the printer housing 12, the up-down direction 7, the front-back direction 8, and the left-right direction 9 of the main unit 11 of the ink recording device 10 are aligned with the up-down direction 51, the front-back direction 52, and the left-right direction 53 of the tray unit 50, respectively. The main tray 60 is an example of a first tray. The discharge tray 80 is an example of a cover and a discharged sheet receiver.

Figure 6:
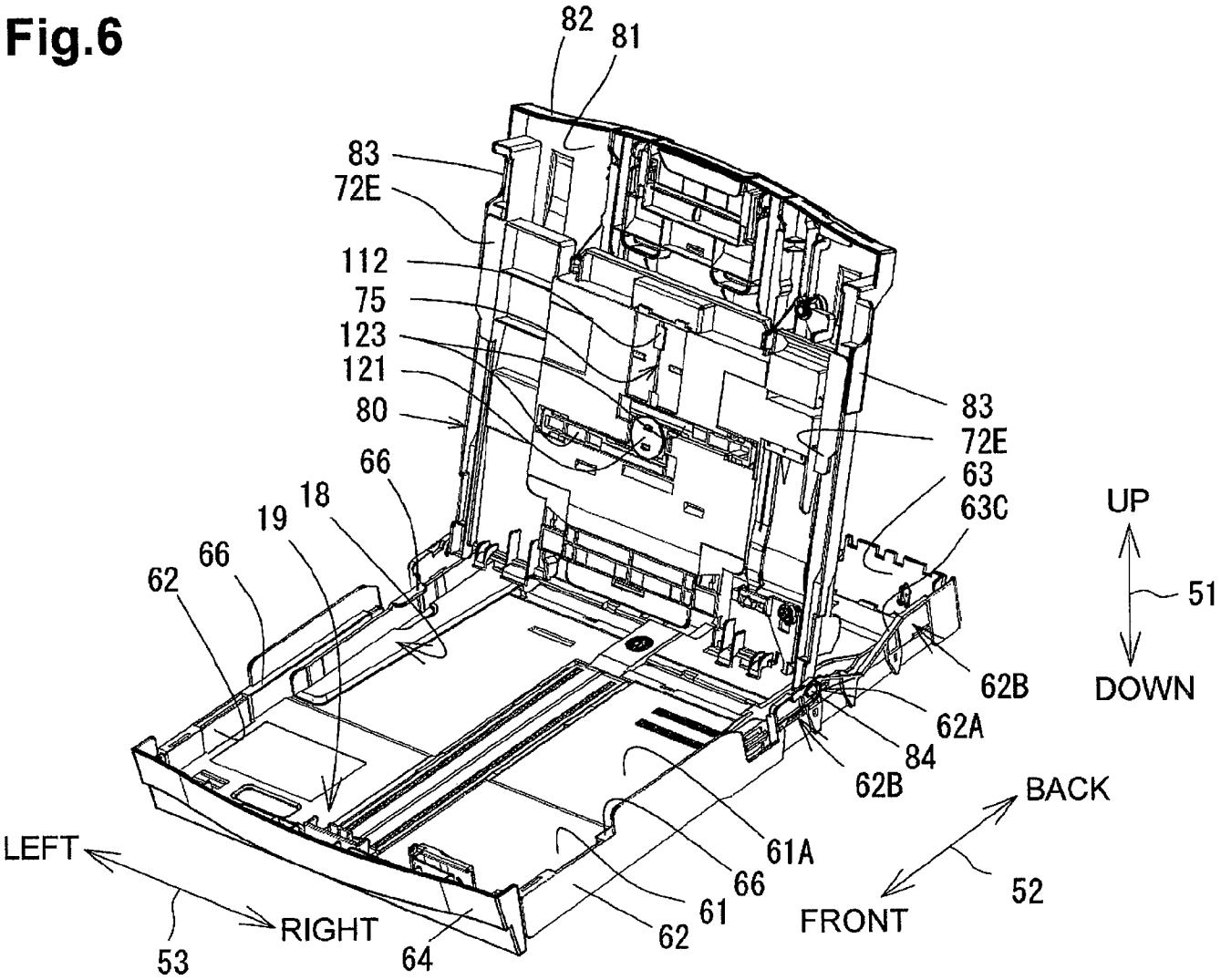
FIG. 6 is a perspective view of the tray unit when the second tray and a discharge tray are opened.
Figure 7:
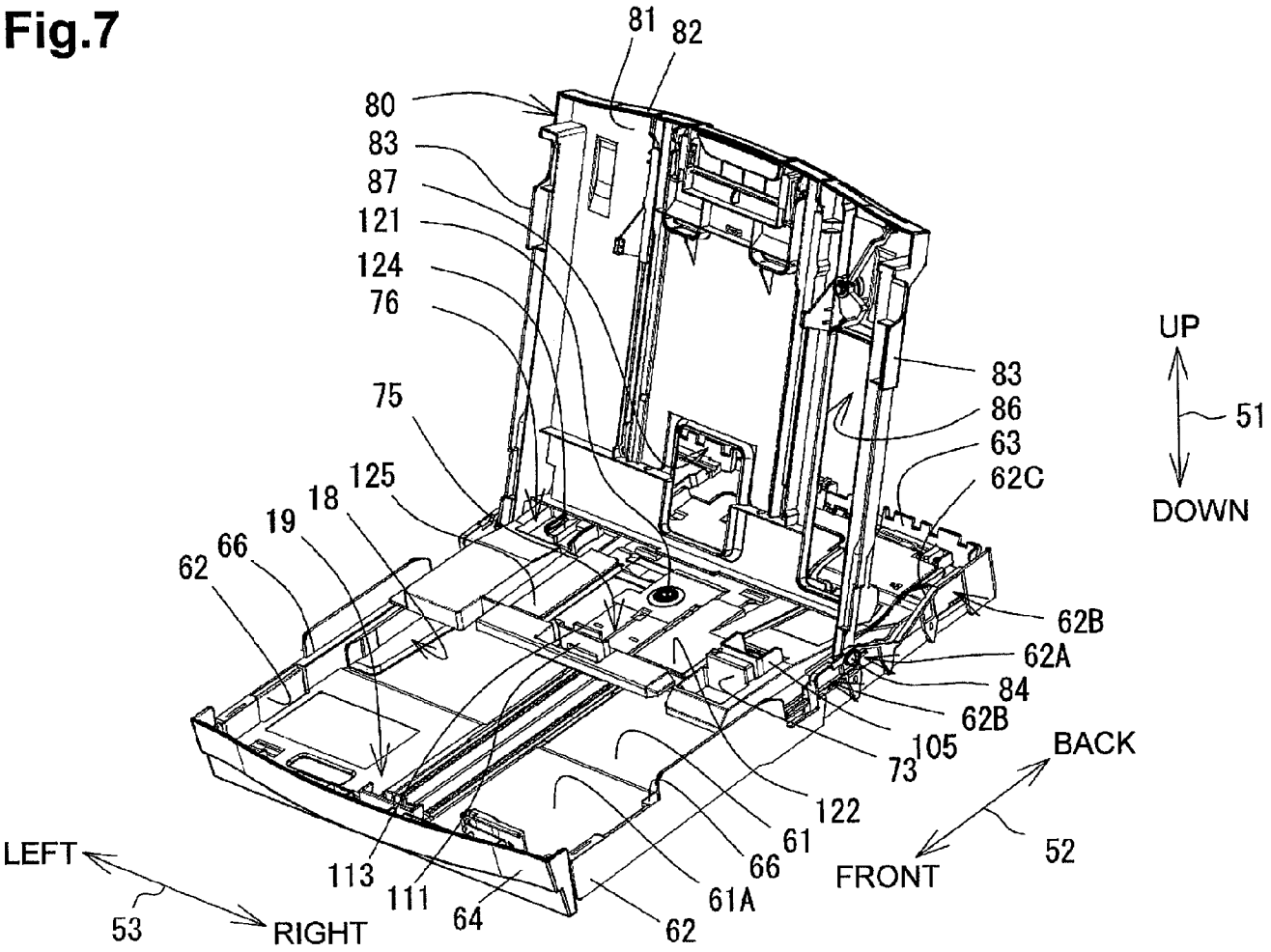
FIG. 7 is a perspective view of the tray unit when the discharge tray is opened.

As shown in FIGS. 6 and 7, the main tray 60 has the shape of a box that is open at the top, and comprises a rectangular plate-shaped bottom 61 on which the first sheets 54A (see FIG. 2) can be placed, left and right side walls 62, a back wall 63, and a front wall 64. The first sheets 54A (see FIG. 2) are placed on an inner bottom surface 61A of the main tray 60. The inner bottom surface 61A is an example of a first holding surface.

The back wall 63 is inclined with respect to the bottom 61 such that the back wall 63 extends obliquely upward and backward from a back end portion of the bottom 61. Each of the first sheets 54A and the second sheets 54B fed by the above-described feeder 20 (see FIG. 2) is conveyed obliquely upward and backward by sliding along an inner surface of the back wall 63. Thus, the back wall 63 has a function of guiding each sheet 54 to the convey path 31 (see FIG. 2).

The back wall 63 has left and right notches 63A. The notches 63A are formed by cutting out the top edge of the back wall 63. Fitting pieces 71B, which will be described below, formed on the second tray 70 are fitted to the notches 63A.

The left and right side walls 62 comprise guiderails 66 for supporting the second tray 70 and shaft holes 62A for supporting the discharge tray 80. A front portion of each guiderail 66 in the front-back direction 52 is provided on the inner surface of the side wall 62 so as to support the second tray 70 at the top surface of the guiderail 66. A back portion of each guiderail 66 is formed in the side walls 62 as a groove extending in the front-back direction 52 so as to support the second tray 70 in the groove. The guiderails 66 support the second tray 70 such that the second tray 70 is slidable in the front-back direction 52. The shaft holes 62A are formed through the side walls 62, and projecting shafts 84 of the discharge tray 80, which will be described below, are inserted through the shaft holes 62A, respectively. Each shaft hole 62A is provided between a central part and the back end of the corresponding side wall 62 in the front-back direction 52.

Front and back lock holes 62B are formed in the right side wall 62. As described below, the lock holes 62B have a function of fixing a sliding portion 71 of the second tray 70. The lock holes 62B are an example of first positioning members, and the right side wall 62 in which the lock holes 62B are formed is an example of a stationary wall.

The right side wall 62 has, as a part of the top surface thereof, the first contact surface 62C whose height decreases toward the front. When the contact portion 22A of the above-described arm 22 makes slide contact with the first contact surface 62C, the feed rollers 23 move vertically.

A side guide mechanism 18 and a rear guide mechanism 19 are provided on the bottom 61 of the main tray 60 to properly position the first sheets 54A (see FIG. 2) on the bottom 61 of the main tray 60. The structures of the side guide mechanism 18 and the rear guide mechanism 19 are similar to those of a side guide mechanism 122 and a rear guide mechanism 110 (see FIG. 8) provided on the second tray 70, and explanations thereof are thus omitted here.

Figure 8:
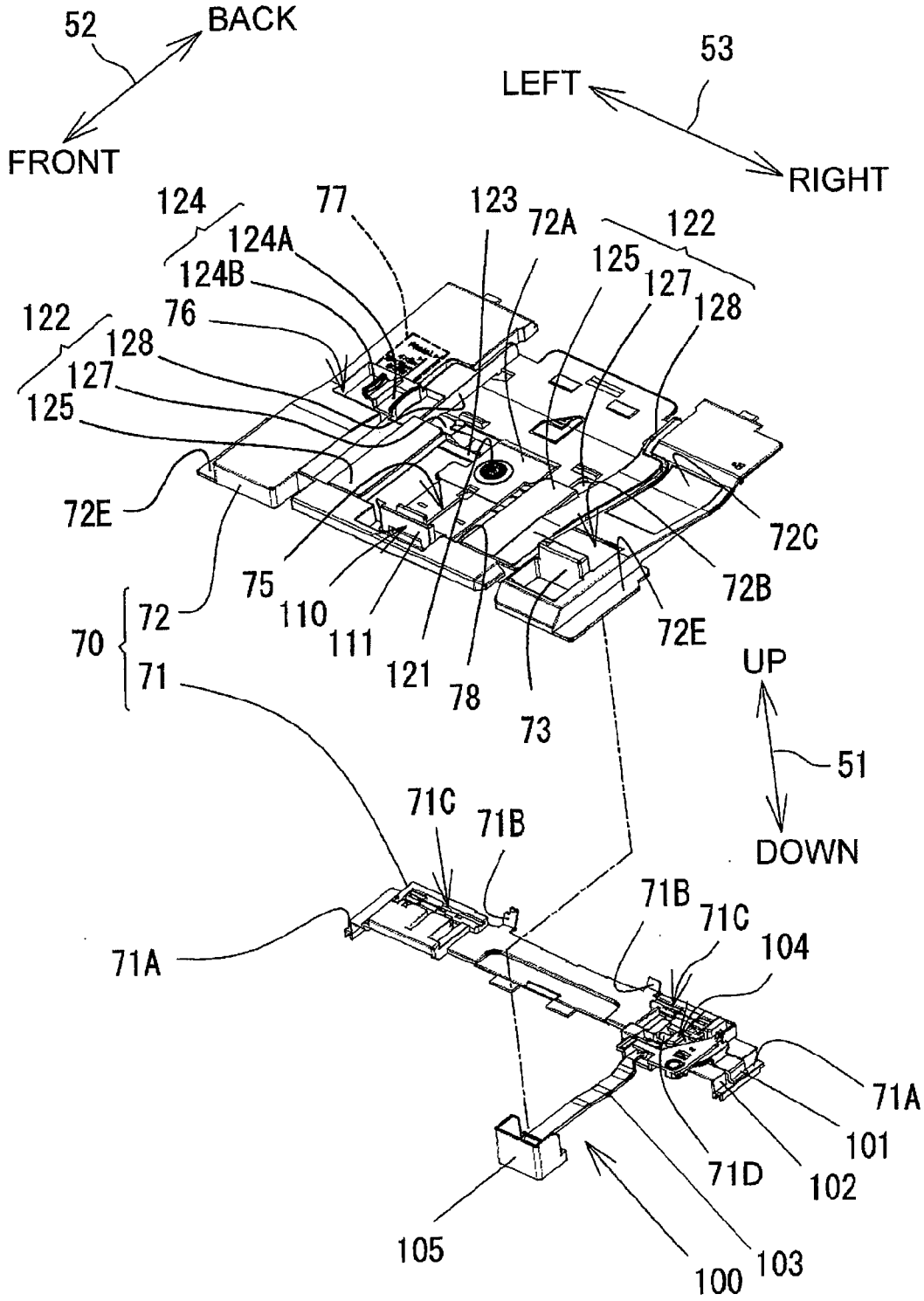
FIG. 8 is an exploded perspective view of the second tray.

As shown in FIG. 8, the second tray 70 comprises a rectangular plate-shaped sliding portion 71 that extends in the left-right direction 53 and a rectangular plate-shaped pivoting portion 72 that is disposed on a more front side than the sliding portion 71. The second sheets 54B are placed on a slidable holding surface, which is the top surface of the sliding portion 71, and a pivotable holding surface 72A, which is the top surface of the pivoting portion 72. The pivotable holding surface 72A is an example of a second holding surface. The first sheets 54A and the second sheets 54B may either be different types of sheets or the same type of sheets.

As shown in FIG. 8, first flanges 71A project from the left and right ends of the sliding portion 71. The first flanges 71A are supported by the above-described guiderails 66 (see FIG. 6) provided on the main tray 60. The first flanges 71A slide along the groove-shaped portions of the guiderails 66 provided at the side walls 62. Accordingly, the sliding portion 71 moves in the front-back direction 52. Thus, the sliding portion 71 is supported by the main tray 60 such that the sliding portion 71 is slidable in a sliding direction, e.g., in the front-back direction 52.

A locking mechanism 100 is provided on the right part of the sliding portion 71. The locking mechanism 100 comprises a lock member 101, a retaining portion 102, a first spring 71D, a connecting bar 103, a second support portion 104, a release lever 105, and a transmission mechanism (not shown). The lock member 101 is supported by the retaining portion 102 such that the lock member 101 is movable in the left-right direction 53. The first spring 71D urges the lock member 101 rightward. The second support portion 104 supports an end of the connecting bar 103 such that the connecting bar 103 is pivotable and is movable in the front-back direction 52. The connecting bar 103 pivots between a position to project forward from the sliding portion 71 and a position to project upward from the sliding portion 71. The connecting bar 103 moves in the front-back direction 52 when the connecting bar 103 is in the position to project forward from the sliding portion 71. The release lever 105 projects upward from a front end of the connecting bar 103 when the connecting bar 103 is in the position to project forward from the sliding portion 71.

When the release lever 105 is moved forward in FIG. 8 by a user, the transmission mechanism moves, in response to a movement of the connecting bar 103, the lock member 101 leftward against the urging force applied by the first spring. Thus, the lock member 101 is moved from a projecting position shown in FIG. 8 to a retracted position. When the user releases the release lever 105, the lock member 101, which is urged by the above-described first spring, is fitted into the front lock hole 62B or the back lock hole 62B. In the following description, the sliding portion 71 is described as being in a front position when the lock member 101 is fitted in the front lock hole 62B, and is described as being in a back position when the lock member 101 is fitted in the back lock hole 62B.

The user recognizes that the sliding portion 71 has reached the front position or the back position from a tactile sensation or a sound generated when the lock member 101 is fitted into one of the lock holes 62B. Thus, the second tray 70 is prevented from being left in an intermediate position. The first spring 71D is an example of an urging member. The lock member 101 is an example of a second positioning member.

Left and right fitting pieces 71B project upward and backward from the back end of the sliding portion 71. When the sliding portion 71 is in the above-described back position, the fitting pieces 71B are fitted to the above-described notches 63A formed in the back wall 63 of the main tray 60. When the fitting pieces 71B are fitted to the notches 63A, the second tray 70 is properly positioned with respect to the left-right direction 53.

Left and Right second flanges 72E project from the left and right sides of the pivoting portion 72, which is rectangular plate-shaped. The second flanges 72E and the above-described first flanges 71A are supported on the top surfaces of the guiderails 66 (see FIG. 6) of the main tray 60. Thus, both the pivoting portion 72 and the sliding portion 71 are slidably supported by the main tray 60.

The pivoting portion 72 is supported on a first support portion 71C of the sliding portion 71 in a pivotable manner. The pivot axis of the pivoting portion 72 substantially coincides, in position, with the pivot axis of the connecting bar 103 and moves as the sliding portion 71 slides. When the sliding portion 71 is in the front position, the pivot axis of the pivoting portion 72 substantially coincides, in position, with the pivot axis of the discharge tray 80. As will be described below, the discharge tray 80 is supported by the main tray 60 at the shaft holes 62A in a pivotable manner. The pivoting portion 72 pivots between a lying position in which the pivotable holding surface 72A faces upward and extends along the inner bottom surface 61A (first holding surface) of the main tray 60, and a standing position in which the pivotable holding surface 72A stands upward with respect to the inner bottom surface 61A.

Figure 4:
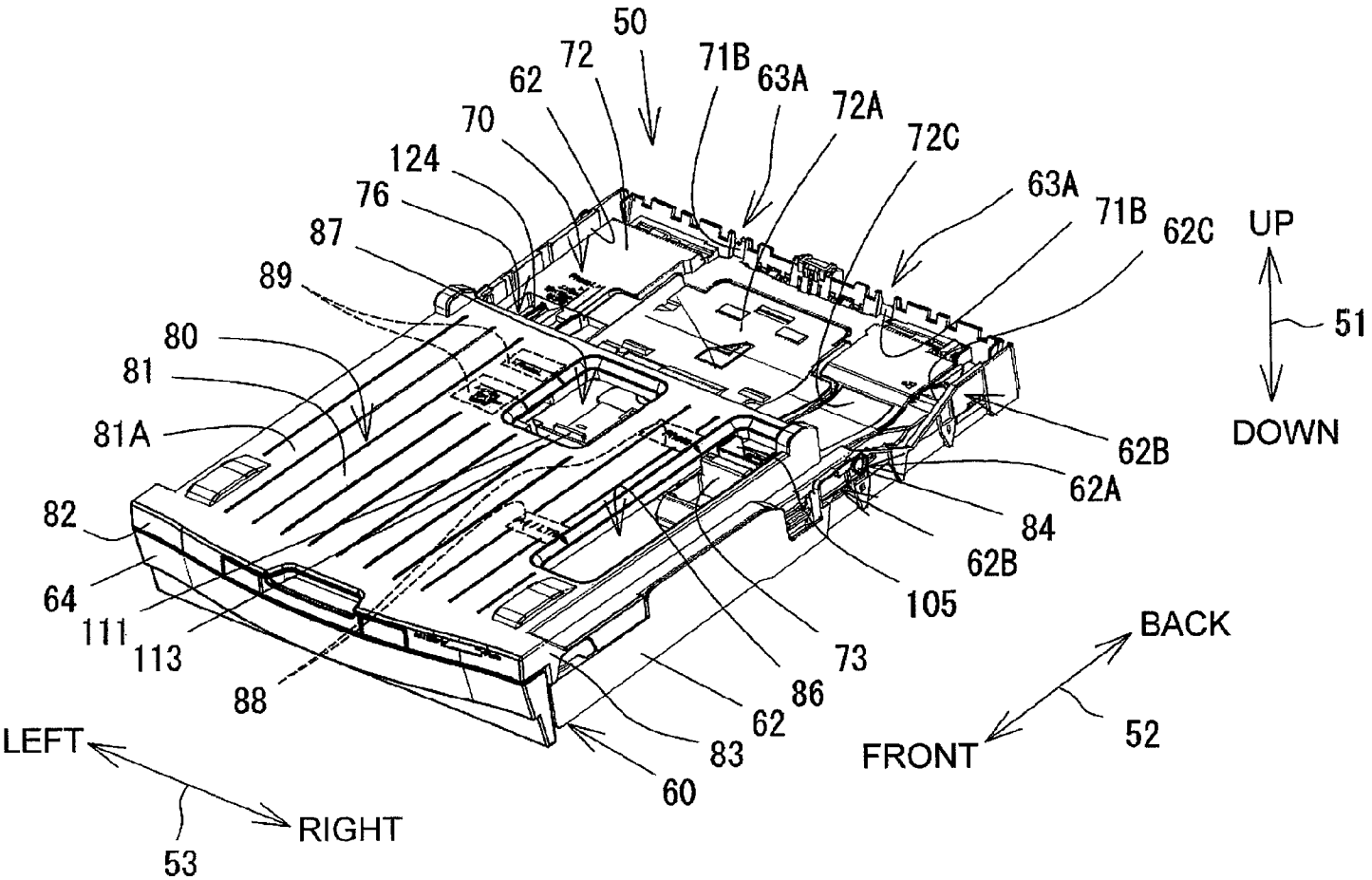
FIG. 4 is a perspective view of a tray unit of the image recording device when a second tray is in a feeding position.
Figure 5:
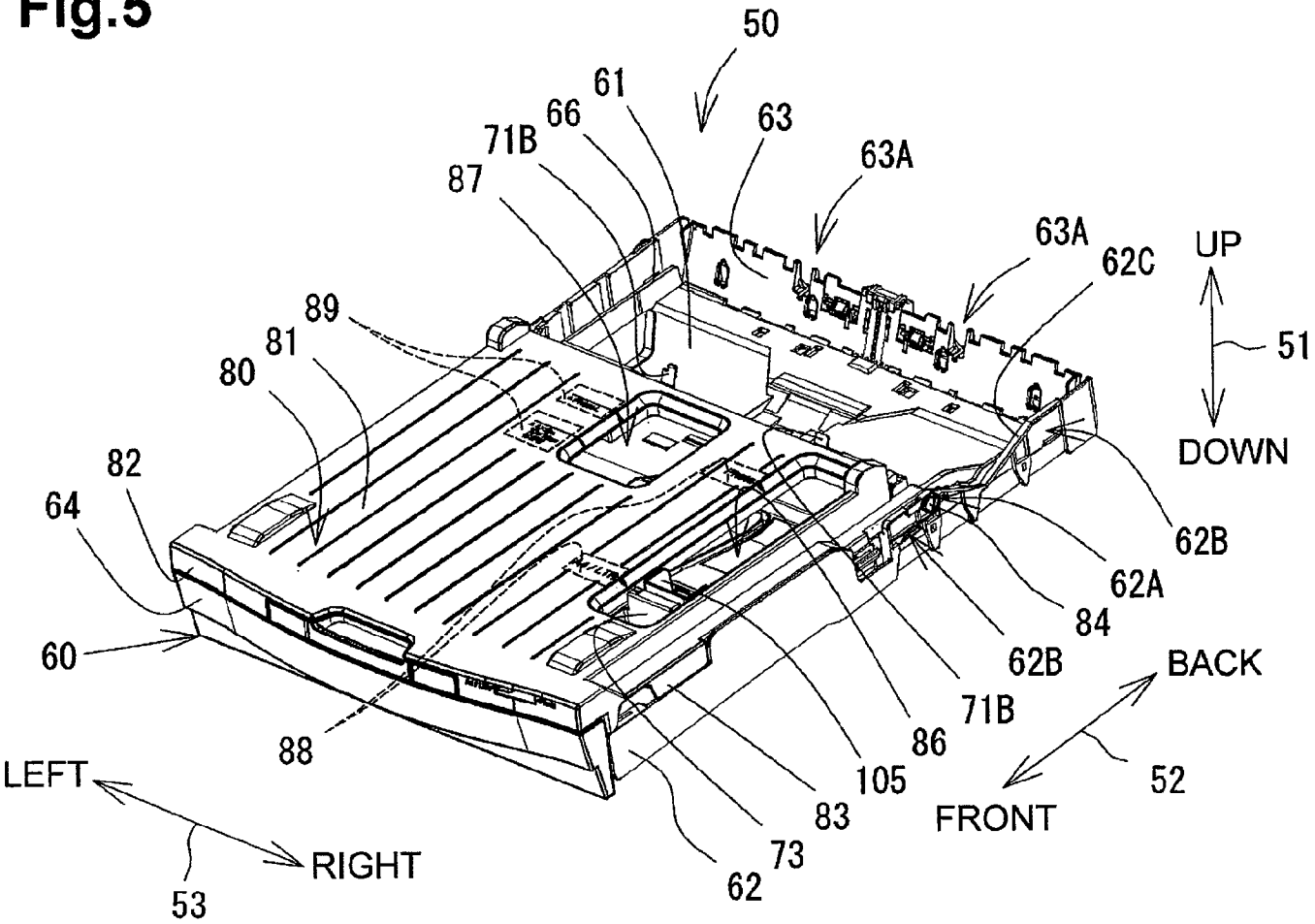
FIG. 5 is a perspective view of the tray unit when the second tray is in a retracted position.

In the following description, the second tray 70 is described as being in a feeding position when the sliding portion 71 is in the above-described back position and the pivoting portion 72 is in the above-described lying position, as shown in FIG. 4. The second tray 70 is described as being in a retracted position when the sliding portion 71 is in the above-described front position and the pivoting portion 72 is in the above-described lying position, as shown in FIG. 5. The feeding position is an example of a first position, and the retracted position is an example of a second position. The standing position pivoting from the retracted position is an example of a third position. The second position is upstream from the first position in a first direction in which the sheets 54 are fed. When the second tray 70 is in the feeding position, the pivotable holding surface 72A faces the feed rollers 23 of the feeder 20. Accordingly, the second sheets 54B placed on the pivotable holding surface 72A are fed toward the recording unit 40. When the second tray 70 is in the retracted position, the inner bottom surface 61A (first holding surface) of the main tray 60 faces the feed rollers 23. Accordingly, the first sheets 54A placed on the inner bottom surface 61A are fed toward the recording unit 40.

As shown in FIG. 8, the pivoting portion 72 has, in the right part thereof, an insertion hole 72B into which the release lever 105 is inserted from below. An operation lever 73 projects upward from the top surface of a peripheral wall around the insertion hole 72B at the front side thereof. The operation lever 73 faces, in the front-back direction 52, the release lever 105 that is inserted into the insertion hole 72B from below. The user pulls the release lever 105 toward the operation lever 73 by the fingers, so that the lock member 101 is released from the lock hole 62B. Then, the user moves the operation lever 73 and the release lever 105 in the front-back direction 52, thereby sliding the second tray 70. The release lever 105 and the operation lever 73, which are operated to move the second tray 70, are an example of a second operation member.

The pivoting portion 72 has the second contact surface 72C as a part of the top surface thereof. The second contact surface 72C is provided on the right part of the pivoting portion 72, and is inclined such that the height thereof decreases toward the front. When the tray unit 50 is mounted into the printer housing 12 (see FIG. 1) while the second tray 70 is in the above-described feeding position, the above-described arm 22 (see FIG. 3) makes slide contact with the second contact surface 72C such that the feed rollers 23 are lowered and come into contact, from above, with a top surface of the second sheets 54B (see FIG. 2) placed on the pivoting portion 72.

As shown in FIG. 8, the pivoting portion 72 has a guiding long hole 75 and an operation recess 76 in a front area thereof. The guiding long hole 75 extends through the pivoting portion 72 and in the front-back direction 52. The guiding long hole 75 is provided in a central part of the pivoting portion 72 in the left-right direction 53. The operation recess 76 is provided on a left part of the pivoting portion 72 and is open to the pivotable holding surface 72A (second holding surface). The operation recess 76 has a pair of inner surfaces that face each other in the front-back direction 52. The functions of the guiding long hole 75 and the operation recess 76 will be described below, along with a description of the rear guide mechanism 110 and the side guide mechanism 120.

Referring to FIG. 8, the rear guide mechanism 110 comprises a rear guide 113 placed on the pivotable holding surface 72A so as to extend over peripheral walls at the left and right sides of the above-described guiding long hole 75; a guide piece (not shown) that projects downward from the rear guide 113 so as to extend through the guiding long hole 75; and a retaining portion 112 (see FIG. 6) arranged such that the peripheral walls at the left and right sides of the guiding long hole 75 are placed between the rear guide 113 and the retaining portion 112 in the thickness direction of the pivoting portion 72. Thus, the rear guide 113 is supported by the pivoting portion 72 such that the rear guide 113 is movable in the front-back direction 52. The user holds a first lug 111 (see FIG. 7) that is provided on the rear guide 113, and moves the first lug 111 such that the back end of the rear guide 113 comes into contact with the front edges of the second sheets 54B (see FIG. 2) that are placed on the pivotable holding surface 72A. The second sheets 54B are sandwiched by the rear guide 113 and the above-described fitting pieces 71B provided on the sliding portion 71 and are properly positioned in the front-back direction 52.

The side guide mechanism 120 comprises a pinion gear 121 that is rotatably retained in a central part of the pivoting portion 72 in the left-right direction 53; left and right side guides 122 arranged at the left and right sides of the pinion gear 121; left and right rack gears 123, each of which is coupled to the corresponding side guide 122 at one end thereof and is meshed with the pinion gear 121 at the other end thereof; and a second lug 124 that is connected to the left side guide 122 and disposed in the above-described operation recess 76.

Each of the side guides 122 that face each other in the left-right direction 53 comprises a holding plate 127 that is coupled to the corresponding rack gear 123 and forms a part of the pivotable holding surface 72A; a side plate 128 that stands upward with respect to the holding plate 127 and the pivotable holding surface 72A; and a top plate 125 that is supported by the side plate 128 so as to face the holding plate 127 and the pivotable holding surface 72A in a direction perpendicular to the pivotable holding surface 72A (up-down direction 51 in FIG. 8).

Figure 9A:
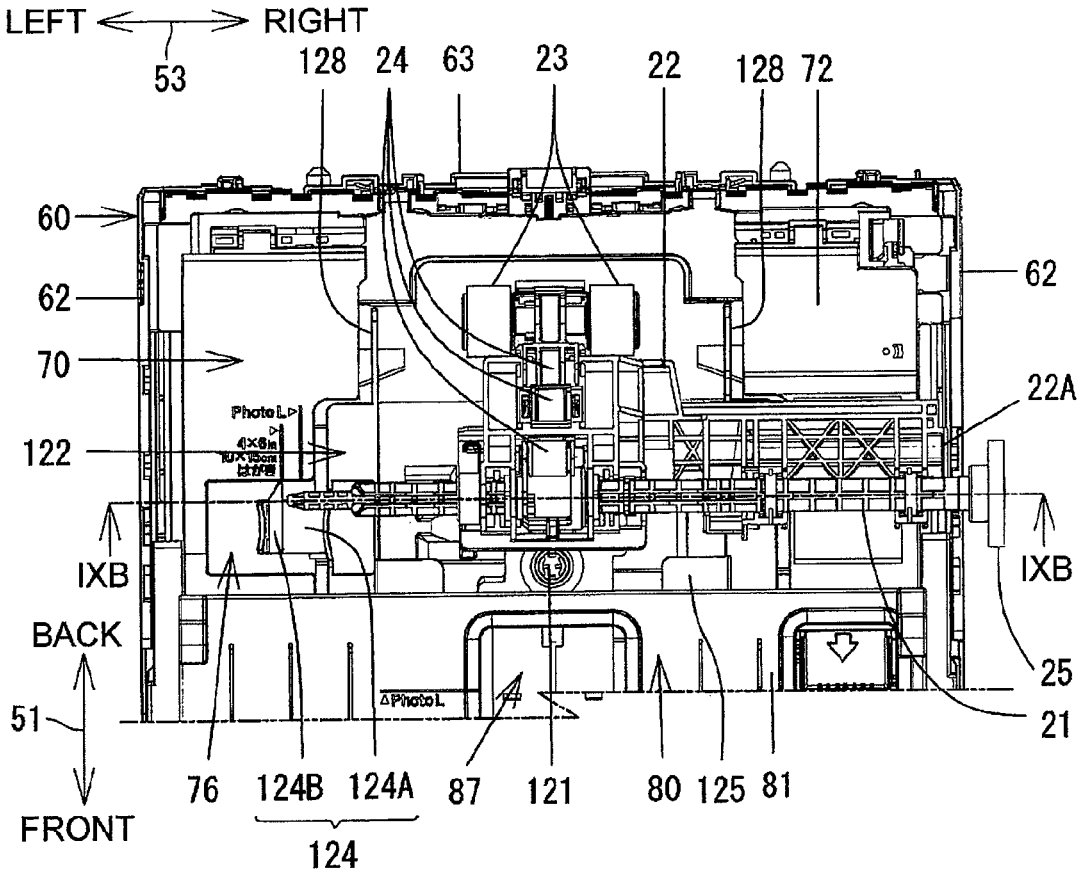
FIG. 9A is a plan view of the feeder and the tray unit.

The top plates 125 project from the top edges of the side plates 128 toward the central part of the pivoting portion 72 in the left-right direction 53. The top plates 125 are provided on front portions of the side plates 128. Since the top plates 125 are provided on the front portions of the side plates 128, when the second tray 70 is in the feeding position, the top plates 125 are positioned so as to project backward from the discharge tray 80, as shown in FIG. 9A.

In the left side guide 122, the side plate 128 is connected to the left edge of the holding plate 127. In the right side guide 122, the side plate 128 is connected to the right edge of the holding plate 127. The height of the side plates 128 is set such that the top plates 125 do not interfere with the discharge tray 80.

When the second sheets 54B are placed on the second tray 70, the second sheets 54B are guided onto the pivotable holding surface 72A by the bottom surface of the top plate 125 that faces the pivotable holding surface 72A. The side guides 122 also comprise front walls 78 that stand upward from the pivotable holding surface 72A. The front edges of the side plates 128 and the top plates 125 are near the front walls 78. Since the front edges of the side plates 128 and the top plates 125 are near the front walls 78, the second sheets 54B guided by the top plate 125 can be prevented from passing over the front walls 78 and can be positioned by coming into contact with the front walls 78.

The second lug 124 comprises a deformable portion 124A and an upright portion 124B. The deformable portion 124A is elastically deformable and is disposed along the pivotable holding surface 72A. The deformable portion 124A is connected to the left side guide 122. The upright portion 124B extends upward so as to project from the deformable portion 124A. The second lug 124 is movable in the left-right direction 53 along the pair of inner surfaces of the operation recess 76 that face each other in the front-back direction 52. The length of the second lug 124 in the left-right direction 53 is smaller than the width of the operation recess 76 in the left-right direction 53, and the second lug 124 is movable within the width of the operation recess 76. Thus, the movable range of the second lug 124 and the side guide 122 connected thereto in the left-right direction 53 is determined by the width of the operation recess 76. The width of the operation recess 76 is set in accordance with the sizes of the second sheets 54B.

As shown in FIG. 8, the second lug 124 and the operation recess 76 are arranged in a substantially central part of the pivoting portion 72 of the second tray 70 in the front-back direction 52. Therefore, as shown in FIG. 4, the second lug 124 is positioned behind the discharge tray 80 and exposed in the state in which the second tray 70 is in the feeding position.

When the user moves the second lug 124 rightward or leftward, the left side guide 122 and the left rack gear 123 that are connected to the second lug 124 are also moved leftward or rightward. When the left rack gear 123 is moved, the pinion gear 121 is rotated. Accordingly, the right rack gear 123 that meshes with the pinion gear 121 and the right side guide 122 are moved leftward or rightward in response to the rotation of the pinion gear 121. Thus, the pair of side guides 122 are moved toward or away from each other in association with each other. The user moves the second lug 124 such that the inner surfaces of the side plates 128 of the left and right side guides 122 come into contact with the left and right edges of the second sheets 54B placed on the pivotable holding surface 72A. Thus, the second sheets 54B are properly positioned in the left-right direction 53. The second sheets 54B are properly positioned on the pivotable holding surface 72A by the above-described rear guide mechanism 110, the fitting pieces 71B, and the side guide mechanism 120.

The second sheets 54B are inserted between the top plate 125 and the holding plate 127 of each of the side guides 122 that face each other, and the back edges of the second sheets 54B come into contact with the fitting pieces 71B. Therefore, when the pivoting portion 72 is pivoted, the second sheets 54B are retained by the top plates 125, the holding plates 127, and the fitting pieces 71B, and are prevented from falling from the pivoting portion 72.

In addition, since the second sheets 54B are inserted between the top plate 125 and the holding plate 127 of each of the side guides 122 that face each other, the number of second sheets 54B that can be received is limited by the top plates 125. Thus, the height of the stack of second sheets 54B is limited. Therefore, the second sheets 54B are prevented from coming into contact with the discharge tray 80 when the second tray 70 is slid. Thus, the top plates 125 also have a function of protecting the second sheets 54B from the discharge tray 80.

When the second sheets 54B are placed on the second tray 70, the second sheets 54B slide along the bottom surfaces of the top plates 125 that face the holding plates 127. Therefore, the second sheets 54B are guided to the pivotable holding surface 72A without passing over the side plates 128 of the side guides 122 or the rear guide 113. Thus, the top plates 125 have a function of guiding the second sheets 54B and preventing the second sheets 54B from being displaced from the pivotable holding surface 72A.

A first mark 77 is provided at an edge of the opening of the operation recess 76 and shows the information for positioning the second sheets 54B to be placed on the pivotable holding surface 72A. The user moves the side guides 122 in accordance with the type of the second sheets 54B to be placed and the information shown by the first mark 77.

Figure 9B:
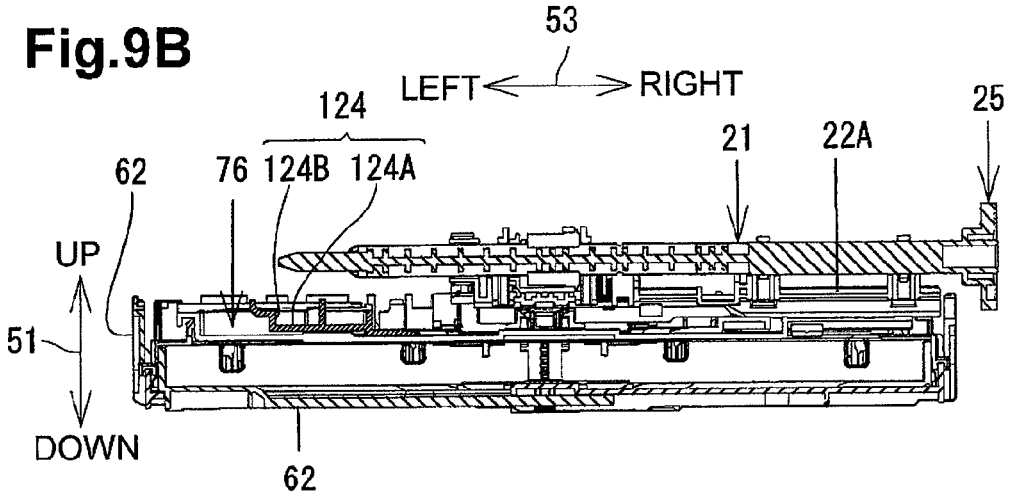
FIG. 9B is a cross-sectional view of the feeder and the tray unit taken along line A-A of FIG. 9A.

The second lug 124 comprises the upright portion 124B that projects upward from the pivotable holding surface 72A so that the user can easily hold the upright portion 124B. The location of the second lug 124 is limited by the positional relationship between the second lug 124 and the discharge tray 80. As described above, the first contact surface 62C and the second contact surface 72C along which the contact portion 22A of the arm 22 slides are provided on the right part of the tray unit 50, and the operation recess 76 in which the second lug 124 is disposed is provided on the left part of the tray unit 50. The arm 22 extends from the contact portion 22A to the feed rollers 23 such that the feed rollers 23 are raised by the arm 22. Thus, the second lug 124 is provided on one of left and right parts of the image recording device 10, and the arm 22 is provided on the other part. Therefore, as shown in FIGS. 9A and 9B, the arm 22 and the second lug 124 do not come into contact with each other. In other words, the second lug 124 is provided on the tray unit 50 such that the second lug 124 does not interfere with the arm 22.

As shown in FIGS. 4 to 7, the discharge tray 80 comprises a rectangular plate-shaped base 81 that is capable of supporting the first sheets 54A and the second sheets 54B, a front wall 82, left and right side walls 83, and left and right projecting shafts 84 that serve as a pivot shaft. The left and right projecting shafts 84 project from back end portions of the left and right side walls 83 in directions away from each other along the left-right direction 53. The discharge tray 80 is configured to cover at least a portion of the second tray 70 irrespective of whether the second tray 70 is in the feeding position or in the retracted position. Thus, the discharge tray 80 functions as a cover of the tray unit 50. The discharge tray 80 reduces the risk that dust will enter the main tray 60 or the second tray 70 and the risk that the sheets 54, the holding surfaces, etc., will be damaged when the tray unit 50 is transported alone or together with the image recording device 10.

The projecting shafts 84 are inserted into the above-described shaft holes 62A in the left and right side walls 62 of the main tray 60 from the inside of the side walls 62. Owing to the projecting shafts 84 and the shaft holes 62A, the discharge tray 80 is supported by the main tray 60 such that the discharge tray 80 is pivotable between a receiving position, e.g., a lying position, shown in FIGS. 4 and 5 and a loading position, e.g., a standing position, shown in FIGS. 6 and 7. When the discharge tray 80 is in the receiving position, a discharged sheet holding surface 81A of the base 81 extends along the inner bottom surface 61A (first holding surface) of the main tray 60. When the discharge tray 80 is in the loading position, the discharged sheet holding surface 81A stands upward with respect to the inner bottom surface 61A of the main tray 60. It is not necessary that the base 81 extend parallel to the inner bottom surface 61A of the main tray 60 when the base 81 is in the receiving position, as long as the base 81 extends substantially along the inner bottom surface 61A such that the discharged sheets 54 can be received by the base 81. The front wall 82, which is a pivoting end of the discharge tray 80A is received by the front wall 64 of the main tray 60.

As described above, the pair of discharge rollers 33 that discharge the sheet 54 after an image is recorded thereon are disposed above a central part of the tray unit 50 in the front-back direction 8. In addition, each of the shaft holes 62A into which the projecting shafts 84 are inserted is provided between a central part and the back end of the corresponding side wall 62 of the main tray 60 in the front-back direction 52. Therefore, in the state in which the tray unit 50 is mounted in the printer housing 12, the back end of the base 81 of the discharge tray 80 in the receiving position is positioned below the discharge rollers 33, so that the discharge tray 80 can receive the sheet 54 having an image recorded thereon and discharged by the discharge rollers 33. The sheet 54 having the image recorded thereon is discharged by the discharge rollers 33 and slides, from a leading edge thereof in the discharging direction, that is, from a front edge thereof, along the discharge tray 80 in the receiving position or along the previously discharged sheet 54. Thus, the sheets 54 are stacked on the discharge tray 80.

The base 81 comprises a first window 86 and a second window 87. The first window 86 is window-shaped and is formed through a right portion of the base 81 in FIG. 4. The first window 86 is formed as a rectangular hole that extends in the front-back direction 52 in FIG. 4. The above-described operation lever 73 and the release lever 105 are exposed to the outside of the tray unit 50 through the first window 86 over the entire sliding range of the second tray 70. In other words, irrespective of whether the second tray 70 is in the feeding position, the retracted position, or any intermediate position therebetween, the operation lever 73 and the release lever 105 are accessible from above. The user slides the second tray 70 by operating the operation lever 73 and the release lever 105 through the first window 86. The operation lever 73 and the release lever 105 are arranged such that they do not project from the top surface of the base 81. Therefore, the sheet 54 having an image recorded thereon and discharged by the pair of discharge rollers 33 are prevented from being blocked by the operation lever 73 or the release lever 105 when the sheet 54 slides along the top surface of the base 81. The first window 86 is an example of a second opening. Because the first window 86 is window-shaped, reduction in the strength of the base 81 is suppressed. However, the first window 86 may instead be formed by cutting an edge of the base 81. The operation lever 73 and the release lever 105, which are surrounded by the first window 86, are made conspicuous.

Second marks 88 are provided at an edge of the first window 86 and each shows the information about the position of the second tray 70 and the information about the type of the sheets 54 subjected to image recording. The user recognizes the position of the second tray 70 and the type of the sheets 54 subjected to image recording from the information shown by the second marks 88 and the position of the operation lever 73 and the release lever 105.

The second window 87 is formed through a back end portion, at a central part of the base 81 in the left-right direction 53 in FIG. 4, so that the above-described rear guide 113 is exposed to the outside of the tray unit 50 through the second window 87. The second window 87 is an example of a first opening. The second window 87 is positioned above the rear guide 113 when the second tray 70 is in the feeding position, and is positioned not above the rear guide 113 when the second tray 70 is in the retracted position. In other words, the rear guide 113 is upwardly exposed when the second tray 70 is in the feeding position, and is covered by the discharge tray 80 when the second tray 70 is in the retracted position.

The length of the second window 87 in the front-back direction 52 is larger than the movable range of the rear guide 113 in the front-back direction 52. In other words, when the second tray 70 is in the feeding position, the user can move the rear guide 113 within the movable range thereof through the second window 87.

Third marks 87 are provided at an edge of the second window 87 and each shows the information about the type of the second sheets 54B to be placed on the pivotable holding surface 72A. The user moves the rear guide 113 in accordance with the information shown by the third marks 89 to properly position the second sheets 54B on the pivotable holding surface 72A.

Figure 10A:
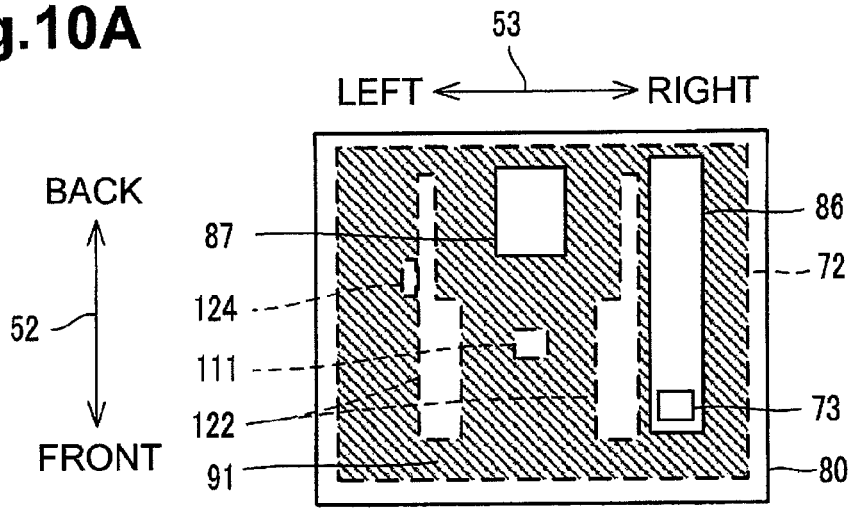
FIG. 10A is a schematic plan view showing a first area of a pivoting portion of the second tray.
Figure 10B:
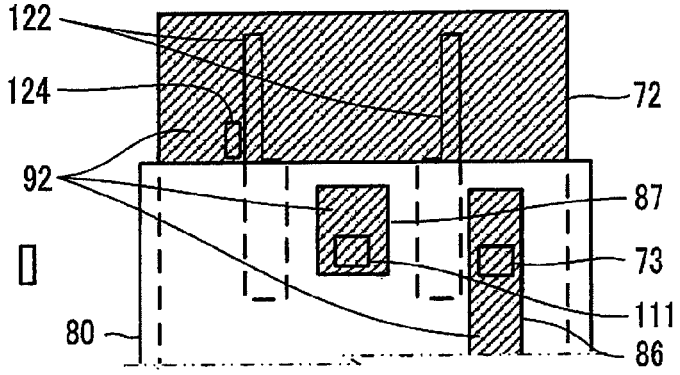
FIG. 10B is a schematic plan view showing a second area of the pivoting portion of the second tray.
Figure 10C:
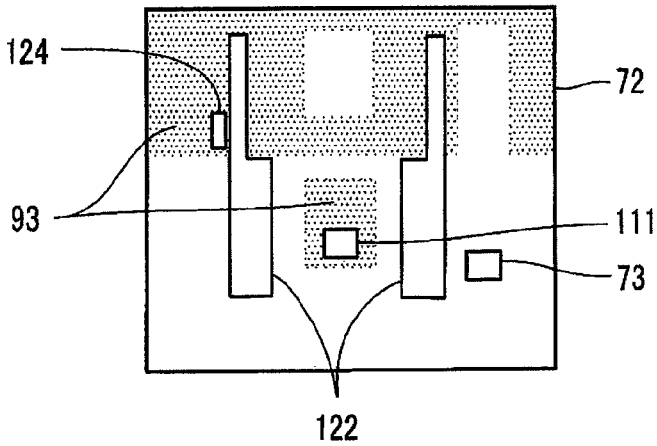
FIG. 10C is a schematic plan view showing a third area of the pivoting portion of the second tray.

A first area 91 that is shown by inclined lines in FIG. 10A is an area of the pivoting portion 72 that is covered by the discharge tray 80 when the second tray 70 is in the retracted position. A second area 92 that is shown by inclined lines in FIG. 10B is an area of the pivoting portion 72 that is not covered by the discharge tray 80 when the second tray 70 is in the feeding position. A third area 93 that is hatched in FIG. 10C shows an area belonging to the first area 91 and the second area 92.

The above-described second lug 124, back portions of the side plates 128, the rear guide 113, and the first lug 111, which are provided on the second tray 70, are in the third area 93. Therefore, when the second tray 70 is in the retracted position so that the first sheets 54A (see FIG. 2) placed on the main tray 60 is fed by the feed rollers 23, the second lug 124, the back portions of the side plates 128, the rear guide 113, and the first lug 111 are invisible for the user. When the second tray 70 is in the feeding position so that the second sheets 54B (see FIG. 2) placed on the second tray 70 is fed by the feed rollers 23, the second lug 124, the back portions of the side plates 128, the rear guide 113, and the first lug 111 are visible for the user. Since the second lug 124, the side guides 122, the rear guide 113, and the first lug 111 are hidden from the user when the second tray 70 is in the retracted position, the user can be prevented from placing the first sheets 54A, which are to be placed on the main tray 60, on the second tray 70 by mistake. In addition, since the second lug 124, the back portions of the side plates 128, the rear guide 113, and the first lug 111 are changed between the visible state and the hidden state, the user can recognize whether the sheets 54 are to be placed on the main tray 60 or the second tray 70. In addition, the user can easily recognize whether the sheets 54 on which images will be recorded are on the main tray 60 or on the second tray 70.

Now, the operation for moving the second tray 70 of the tray unit 50 from the retracted position to the feeding position will be described. When the user grabs the operation lever 73 and the release lever 105 through the first window 86, the locking mechanism 100 is unlocked. Then, the user moves the operation lever 73 and the release lever 105 such that the second tray 70 is moved from the retracted position to the feeding position in the front-back direction 52. When the second tray 70 reaches the feeding position, the second lug 124 and the back portions of the side guides 122, which have been hidden by the discharge tray 80 while the second tray 70 was in the retracted position, are exposed. In addition, the first lug 111 and the rear guide 113, which have also been hidden by the discharge tray 80 while the second tray 70 was in the retracted position, are exposed through the second window 87. Since the second lug 124, the back portions of the side guides 122, the first lug 111, and the rear guide 113 are exposed, the user recognizes that the second sheets 54B are to be placed on the second tray 70. The rear guide 113 and the side guides 122 are each an example of a first guide member, and the first lug 111 and the second lug 124 are each an example of a first operation member. The rear guide 113 is also an example of a second guide member, and the first lug 111 is also an example of a second operation member.

Next, the operation for moving the second tray 70 of the tray unit 50 from the feeding position to the retracted position will be described. Similarly to the above-described case, when the user grabs the operation lever 73 and the release lever 105 and moves the second tray 70 from the feeding position to the retracted position, the second tray 70 is locked into the retracted position by the locking mechanism 100. When the second tray 70 reaches the retracted position, the second lug 124, the back portions of the side guides 122, the first lug 111, and the rear guide 113, which have been exposed while the second tray 70 was in the feeding position, are covered by the discharge tray 80. Since the second lug 124, the side guides 122, the first lug 111, and the rear guide 113 are covered by the discharge tray 80, the user recognizes that the first sheets 54A are to be placed on the main tray 60.

In the present embodiment, the sheets 54 are fed by the feed rollers 23 selectively from the first sheets 54A placed on the bottom 61 of the main tray 60 and the second sheets 54B placed on the second tray 70 by moving the second tray 70 between the feeding position and the retracted position.

In addition, in the present embodiment, the second lug 124, the back portions of the side guides 122, the first lug 111, and the rear guide 113 are disposed in the above-described third area 93 (see FIG. 10C). Therefore, the second lug 124, the side guides 122, the first lug 111, and the rear guide 113 change between the visible state and the hidden state in response to the sliding movement of the second tray 70. As a result, the user can be prevented from placing the first sheets 54A, which are to be placed on the main tray 60, on the second tray 70 by mistake, and the user can easily recognize whether the sheets 54 are to be placed on the main tray 60 or on the second tray 70.

In addition, since the second window 87 is formed in the discharge tray 80, the limitation on the location of the rear guide 113 disposed in the third area 93 can be reduced. As a result, usability of the rear guide 113 can be increased.

In the present embodiment, the rear guide 113, the side guides 122, and the pivoting portion 72 define the storage space for storing the second sheets 54B. However, the discharge tray 80 may have a projection that cooperates with the rear guide 113, the side guides 122, and the pivoting portion 72 to define the storage space when the second tray 70 is in the feeding position. When such a projection is provided, the second sheets 54B can be more properly positioned and can be more reliably prevented from being displaced from the storage space.

In addition, in the present embodiment, the second lug 124, the side guides 122, the first lug 111, and the rear guide 113 change between the visible state and the hidden state in response to the sliding movement of the second tray 70. However, the configuration may instead be such that only the second lug 124 and the first lug 111 change between the visible state and the hidden state in response to the movement of the second tray 70.

In addition, according to the present embodiment, only the rear guide 113 is exposed through the second window 87. However, a window for exposing the side guides 122 when the second tray 70 is in the feeding position may be provided in the discharge tray 80.

In addition, according to the present embodiment, the discharge tray 80, which serves as a cover of the tray unit 50, is used as a discharged sheet receiver.

However, a cover of the tray unit 50 and a discharged sheet receiver may be provided separately, and the discharged sheet receiver may be provided on the main unit 11.

In the present embodiment, the second tray 70 and the discharge tray 80 are separate components, and thus the discharge tray 80 does not move as the second tray 70 slides. Therefore, without considering any interference, caused by the sliding second tray, between the discharge tray and a frame or the like, the discharge tray 80 can be disposed at a desired height above the second tray 70 and close to the pair of discharge rollers 33. In this case, the sheets 54 having the images recorded thereon and discharged by the pair of discharge rollers 33 can be reliably received by the discharge tray 80.

The shapes of the side guides 122 and the rear guide 113 are not limited to those described in the present embodiment as long as a contact member that comes into contact with the edges of the sheets 54 and an operation member to be operated by the user to move the contact member are provided. In addition, the structure, which includes the operation lever 73 and the release lever 105, for sliding the second tray 70 is not limited to that described in the present embodiment as long as an operation member to be operated, by the user to move the second tray 70 is provided.

In the present embodiment, the second tray 70 is configured to slide from the retracted position to the feeding position in a first sliding direction and from the feeding position to the retracted position in a second sliding direction opposite to the first sliding direction. The cover has the second window 87, as an example of a first opening, and the first window 86, as an example of a second opening, and each window is formed at a more upstream position than a downstream end of the cover in second sliding direction. The first lug 111 and the rear guide 113 are exposed upward through the second window 87 when the second tray 70 is in the feeding position and are not exposed upward through the second window 87 when the second tray 70 is in the retracted position. However, the first lug 111 and the rear guide 113 may be exposed upward through the second window 87 when the second tray 70 is in the retracted position.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. A tray unit comprising:

a first tray comprising a first holding surface for holding thereon a first sheet;

a second tray comprising a second holding surface for holding thereon a second sheet and configured to slide above and along the first holding surface from a second position to a first position in a first sliding direction and from the first position to the second position in a second sliding direction opposite to the first sliding direction; and a cover configured to cover from above at least a part of the second tray when the second tray is in the second position, wherein the second tray further comprises:

a guide member standing upward with respect to the second holding surface and configured to move along the second holding surface and to contact an edge of the second sheet held on the second holding surface, and an operation member configured to be operated to move the guide member, and wherein the operation member is covered by the cover when the second tray is in the second position and is exposed from the cover when the second tray is in the first position.

2. The tray unit according to claim 1, wherein the second tray comprises a top plate supported by the guide member such that the top plate faces the second holding surface, and the top plate is exposed upward from the cover when the second tray is in the first position.

3. The tray unit according to claim 1, wherein the operation member is stored in a recess formed in the second tray.

4. The tray unit according to claim 1, wherein the operation member comprises a lug.

5. The tray unit according to claim 1, wherein the second tray is configured to pivot between the second position and a third position in which the second tray stands upward with respect to the first holding surface, and a pivot axis of the second tray moves as the second tray slides between the first position and the second position.

6. The tray unit according to claim 1, wherein the cover is configured to pivot between a lying position in which the cover extends along the first holding surface and a standing position in which the cover stands upward with respect to the first holding surface.

7. The tray unit according to claim 6, wherein the cover comprises a pivot shaft supported by the first tray.

8. The tray unit according to claim 6, wherein a pivoting end of cover is received by the first tray.

9. The tray unit according to claim 1, wherein the first tray comprises a guiderail configured to guide the second tray when the second tray slides between the first position and the second position.

10. A tray unit comprising:

a first tray comprising a first holding surface for holding thereon a first sheet;

a second tray comprising a second holding surface for holding thereon a second sheet and configured to slide above and along the first holding surface from a second position to a first position in a first sliding direction and from the first position to the second position in a second sliding direction opposite to the first sliding direction; and a cover configured to cover from above at least a part of the second tray when the second tray is in the second position, wherein the second tray further comprises:

a guide member standing upward with respect to the second holding surface and configured to move along the second holding surface and to contact an edge of the second sheet held on the second holding surface, and a first operation member configured to be operated to move the guide member, and wherein the cover has a first opening formed at a more upstream position than a downstream end of the cover in the first sliding direction such that the first operation member is exposed upward through the first opening.

11. The tray unit according to claim 10, wherein the first operation member is exposed upward through the first opening when the second tray is in the first position.

12. The tray unit according to claim 11, wherein the guide member is exposed upward through the first opening when the second tray is in the first position.

13. The tray unit according to claim 10, wherein the second tray comprises a second operation member configured to be operated to slide the second tray between the first position and the second position.

14. The tray unit according to claim 13, wherein the cover has a second opening, and the second operation member is exposed upward through the second opening.

15. The tray unit according to claim 14, wherein the second opening has a length larger than an operable range of the second operation member.

16. The tray unit according to claim 13, wherein the first tray comprises two first positioning members spaced apart from each other in the first sliding direction, and wherein the second tray comprises a second positioning member configured to engage with one of the first positioning members when the second tray is in the first position, and with the other of the first positioning members when the second tray is in the second position.

17. The tray unit according to claim 16, wherein the first tray comprises a stationary wall standing upward from the first holding surface and extending along the first sliding direction, and each of the first positioning members has a recess formed in the stationary wall, wherein the second positioning member comprises a lock member configured to move between a projecting position and a retracted position relative to each of the recesses, and the second tray comprises an urging member configured to urge the lock member toward the projecting position, and wherein the second operation member comprises a release portion configured to be operated to move the lock member between the projecting position and the retracted position.

18. The tray unit according to claim 10, wherein the guide member comprises a rear guide configured to contact an upstream edge, in the first sliding direction, of the second sheet held on the second holding surface.

19. The tray unit according to claim 18, wherein the rear guide is exposed upward through the first opening that has a length larger than a movable range of the rear guide.

20. The tray unit according to claim 10, where the cover comprises a mark which is disposed adjacent to the first opening and indicates information for positioning at least one of the second sheet and the guide member.

21. An image recording device comprising:

a first tray comprising a first holding surface for holding thereon a first sheet;

a second tray comprising a second holding surface for holding thereon a second sheet and configured to slide above and along the first holding surface from a second position to a first position in a first sliding direction and from the first position to the second position in a second sliding direction opposite to the first sliding direction;

a cover configured to cover from above at least a part of the second tray when the second tray is in the second position;

a feeder configured to feed the first sheet when the second tray is in the second position and to feed the second sheet when the second tray is in the first position;

a recording unit configured to record an image on the sheet fed by the feeder; and a discharging unit disposed above the cover and configured to discharge the sheet after the recording unit records the image on the sheet, wherein the second tray further comprises:

a guide member standing upward with respect to the second holding surface and configured to move along the second holding surface and to contact an edge of the second sheet held on the second holding surface, and an operation member configured to be operated to move the guide member, and wherein the operation member is covered by the cover when the second tray is in the second position and is exposed from the cover when the second tray is in the first position.

22. The image recording device according to claim 21, wherein the cover comprises a discharged sheet receiver for receiving the sheet discharged by the discharged unit.

23. The image recording device according to claim 21, wherein the feeder comprises:

an arm, a feed roller rotatably attached to one end of the arm, and a shaft for supporting the other end of the arm and configured to be driven to rotate, and wherein the arm comprises a contact portion configured to make slide contact with one of opposite side parts of the second tray in a third direction when the second tray slides, the third direction being a direction parallel to the second holding surface and perpendicular to the first sliding direction.

24. The image recording device according to claim 23, wherein the operation member is disposed on the other of the opposite side parts of the second tray in the third direction.

25. The image recording device according to claim 23, further comprising a housing, wherein the first tray, the second tray, and the cover are configured to be removed unitarily from the housing.

* * * * *